United States Patent [19]

Walker

[11] Patent Number: 4,770,113

[45] Date of Patent: Sep. 13, 1988

[54] WINGSAIL SYSTEMS

[76] Inventor: John G. Walker, Netley Abbey, Southampton, United Kingdom, S035JR

[21] Appl. No.: 5,167

[22] PCT Filed: May 2, 1986

[86] PCT No.: PCT/GB86/00234

§ 371 Date: Jan. 2, 1987

§ 102(e) Date: Jan. 2, 1987

[87] PCT Pub. No.: WO86/06342

PCT Pub. Date: Nov. 6, 1986

[30] Foreign Application Priority Data

May 2, 1985 [GB] United Kingdom ..... 8511232
May 2, 1985 [GB] United Kingdom ..... 8511233
May 2, 1985 [GB] United Kingdom ..... 8511234
May 2, 1985 [GB] United Kingdom ..... 8511235

[51] Int. Cl.[4] ..... B63H 9/04

[52] U.S. Cl. ..... 114/102; 114/103; 114/39.2; 244/45 R

[58] Field of Search ..... 114/102, 103, 39, 90, 114/97, 272, 273, 167; 244/45 R, 82, 78; 440/61

[56] References Cited

U.S. PATENT DOCUMENTS

| | | | |
|---|---|---|---|
| 2,576,294 | 11/1951 | Geraci | 244/45 R |
| 2,996,031 | 8/1961 | Easter | 114/167 |
| 3,587,770 | 6/1971 | Flower | 244/82 X |
| 3,844,238 | 10/1974 | Murray | 114/39 |
| 3,911,847 | 10/1975 | Worthing | 244/78 X |
| 3,934,533 | 1/1976 | Wainwright | 114/103 |
| 3,992,979 | 11/1976 | Smith | 244/78 X |
| 4,467,741 | 8/1984 | Walker | 114/103 |
| 4,543,899 | 10/1985 | Walker | 114/39 |

FOREIGN PATENT DOCUMENTS

| | | | |
|---|---|---|---|
| 403416 | 9/1924 | Fed. Rep. of Germany | 114/103 |
| 2144573 | 4/1973 | Fed. Rep. of Germany | 114/103 |
| 206296 | 11/1984 | Japan | 114/39 |
| 956340 | 9/1982 | U.S.S.R. | 114/103 |

OTHER PUBLICATIONS

"Walker Wingsail Project Rivals Japanese Experience", Motorship, vol. 65, No. 771, 10/1984, pp. 30–31.

*Primary Examiner*—Galen Barefoot
*Assistant Examiner*—Paul E. Salmon
*Attorney, Agent, or Firm*—Young & Thompson

[57] ABSTRACT

A wingsail arrangement comprises a thrust wing having an upright leading airfoil having a leading edge and a trailing edge and an upright trailing airfoil having a leading edge and a trailing edge. The leading edge of the trailing airfoil is positioned closely behind the trailing edge of the leading airfoil. The trailing airfoil is mounted for pivoting movement about an upright axis relative to the leading airfoil from an aligned position in which the trailing airfoil is aligned with the leading airfoil to positions to each side of and angularly displaced from that aligned position. A slat has a leading edge and a trailing edge and is pivoted at its leading edge to the trailing edge of the leading airfoil and connected to the leading edge of the trailing airfoil by at least one cable so as to be moved in response to pivoting movement of the trailing airfoil to form a linear nozzle when the trailing airfoil is angularly displaced from the aligned position. An upright pivot pin is disposed proximate the trailing edge of the slat. Structure for engaging the pivot pin is attached to the cable to enable the cable to pivot about an upright axis relative to the slat. At least one wheel is rotatably mounted about an upright axis disposed proximate the trailing edge of the slat and extending beyond the trailing edge of the slat to prevent mutual engagement of the trailing edge of the slat and the flap.

7 Claims, 9 Drawing Sheets

Figure 15
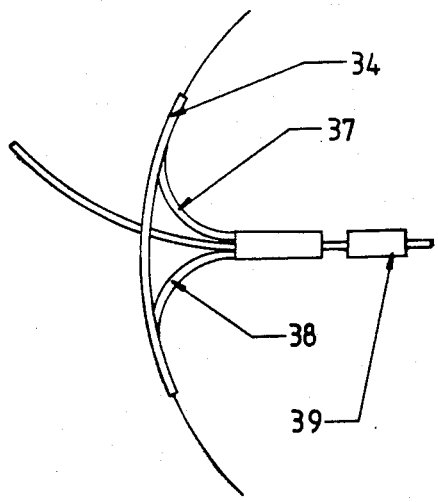
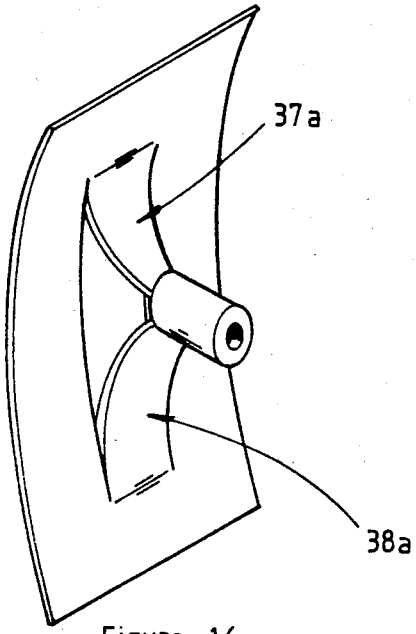
Figure 16
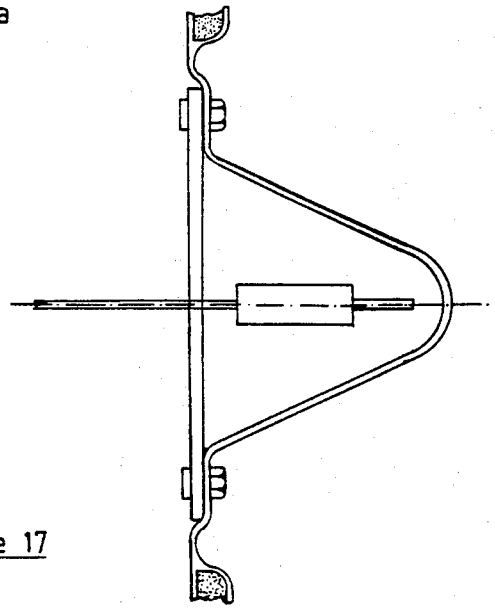
Figure 17

WINGSAIL SYSTEMS

This invention relates to airfoils, and especially to wingsail airfoils.

The wingsail systems with which the present invention is concerned are generally of the self setting type that are mounted freely for rotation about an upright axis. In a wingsail system with a multi-element wing comprising a leading element and a trailing element or flap positioned closely behind the leading element and pivotable to each side to form respective composite cambered configurations, the moment on the hinge of the flap due to airflow is considerable, and must be resisted if the cambered configuration is to be maintained. If a hydraulic ram is used to drive the flap and maintain its position, this necessitates use of a ram large enough to withstand the maximum moment likely to be encountered. A locking device may be employed in order to relieve the ram once the flap is fully deflected, but the hydraulic ram still has to be large in order to defect the flaps in a strong airstream.

Aircraft flaps incorporate devices such as rails and fixed pivots in order to alleviate any analogous problems, however this method is not easily adaptable for wingsail systems because, unlike aircraft flaps, the flap must be capable of deflection in both directions in order to operate on both tacks.

The present invention in one aspect is directed towards a method of assisting the flap to reach operating deflection.

Accordingly in one aspect the present invention provides a method of operating a self-trimming sailset comprising a wingsail having a leading airfoil, a trailing airfoil flap and a governor airfoil, the method comprising adjusting the angle between the governor and the leading airfoil so that the rig is trimmed to a position in which the forces opposing a movement of the flap in a particular direction are reduced, moving the flap in said direction, and then setting the governor to trim the sailset.

The forces may be reversed tending to aid movement of the flap in the particular direction.

The invention also relates to a control system for moving the flap of the self-trimming rig.

In a multi-element wingsail having a leading element and a trailing flap element it has been proposed to locate a slat at the trailing edge of the leading element, the slat extending towards the leading edge of the flap and being connected to it in some way so as to be correctly positioned to form a linear nozzle upon deflection of the flap. With a pivoted slat it is necessary in order for the slat to be operative on either tack for the slat to pass through the gap between the leading and trailing elements. If the connection between the slat and flap is a cable, which has advantages in terms of flexibility, then it may be subject to excessive wear, and also the mounting on the flap may be subject to fouling by the slat.

The present invention in another aspect is directed towards providing more durable cable connection and mounting and to easing the passage of the slat past the leading edge of the flap.

The type of sailset with which the invention is generally concerned is a multi-element, multiplane type, that is, it has a plurality of main thrust wings, each of the thrust wings being composed of at least two airfoil elements, usually a leading element and a trailing flap element. The thrust wings may be trimmed by a governor airfoil such as a tail vane.

It is often desired to stall the thrust wings, for example for running downwind. During stalling the airflow over the airfoil is eddying and turbulent, with the result that a downstream control such as a tail vane may become blanketed and be rendered less effective in controlling the trimming of the thrust wings in the proximity of stalling conditions.

The present invention in a further aspect is directed towards achieving reliable 'in-stall' moment to assist maintenance of stall once entered.

Accordingly the present invention provides a wingsail system comprising a plurality of wings, each comprising a leading element and a trailing flap that can be deflected with respect to the leading element, and in which the spacing between the trailing edges of a pair of flaps is maintained to be less than the spacing between their leading edges.

The invention also provides a method of stalling a wingsail system comprising a plurality of wings, each comprising a leading element and a trailing flap that can be deflected with respect to the leading element, the method comprising deflecting a respectively leeward flap by a greater amount than a respectively windward flap so that the leeward flap stalls earlier.

In a wingsail rig comprising multi-element wings of which one element is deflected relative to another, it is generally desirable for the moving elements to be capable of deflection each way from a central aligned position. It is usually the object for wingsails to exhibit similar capability on both port and starboard tacks and for this purpose arrangments capable of adopting mirror image configurations are favoured.

The present invention is also directed towards providing a system that will deflect a moving airfoil with equal speed in each direction, and towards providing a failsafe system for airfoil movement.

Accordingly the present invention additionally provides a wingsail deflection system comprising at least two fluid operated cylinders connected so that a first cylinder operates on an inward stroke and a second cylinder operates on an outward stroke to move a member, the cylinders being interconnected so that fluid is simultaneously conducted to and from each of the cylinders with the rod side of each cylinder being interconnected to the piston side of the other cylinder.

DESCRIPTION OF THE DRAWINGS

FIG. 15 shows a preferred embodiment of attachment of the cable to the flap;

FIG. 16 shows a modification to the embodiment of FIG. 7;

FIG. 17 shows a modification to the leading edge of the flap;

DETAILED DESCRIPTION

Figure 1:
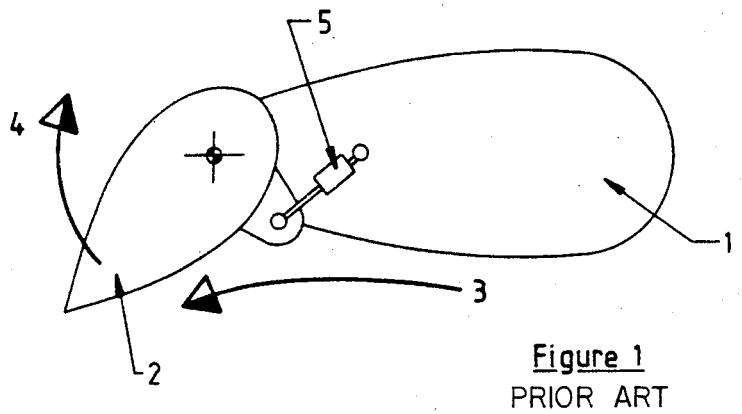
Figure 1 PRIOR ART
FIG. 1 is a schematic diagram of a two section wingsail showing the hinge moment.

Referring to FIG. 1 a wingsail comprising a leading airfoil 1 and a trailing airfoil flap 2 is shown with the flap 2 deflected for tacking. The airflow, shown generally by the arrow 3, creates a positive pressure on the flap tending to rotate the flap away from its deflected position as shown by arrow 4. It will be seen that the movement of the flap is resisted by a hydraulic ram 5 (or some other operating device). A pinlock, or other device may be incorporated into the hinge in order to relieve the stress on the hydraulic system during tacking, but never-the-less the flap moving system is still subject to stress when moving the flap in a strong airstream, and unless it is very heavy (and therefore expensive) may become overstressed before the position is reached at which the pin can be inserted.

In order to reduce the stress on the hydraulic system when the flaps are being deflected, a method of operating a self trimming wingsail system has been devised in which the trimming system is operated in order to reduce the movement opposing moment about the flap hinge. A self-trimming wingsail is one in which a governor airfoil, preferably in the form of a tail vane mounted on a boom is used to trim the main airfoil, the desired angle of attack being set by the relative deflection to the governor which then trims the main airfoil wings and retrims during changes in wind direction. The method of operating the self-trimming rig to reduce flap hinge moments comprises, for a tail vane governor, deflecting the tail vane to full deflection on the same side as that to which it is intended to deflect the flap on the main airfoil wings. This will rotate the main airfoil so that the resistive force on the flap is much reduced, or even eliminated and replaced by a force assisting deflection. The flap is then deflected, locked and the tail vane readjusted to trim to the desired angle of attack.

Figure 2:
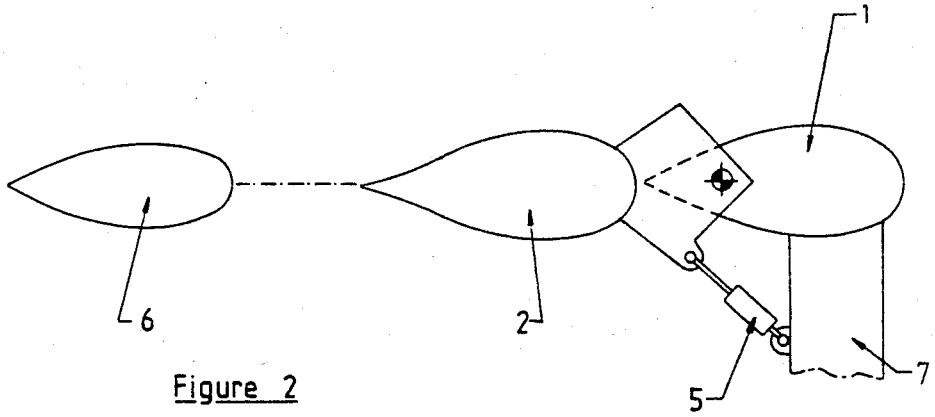
FIG. 2 is a schematic diagram of a self trimming wingsail rig with all airfoil aligned.
Figure 3:
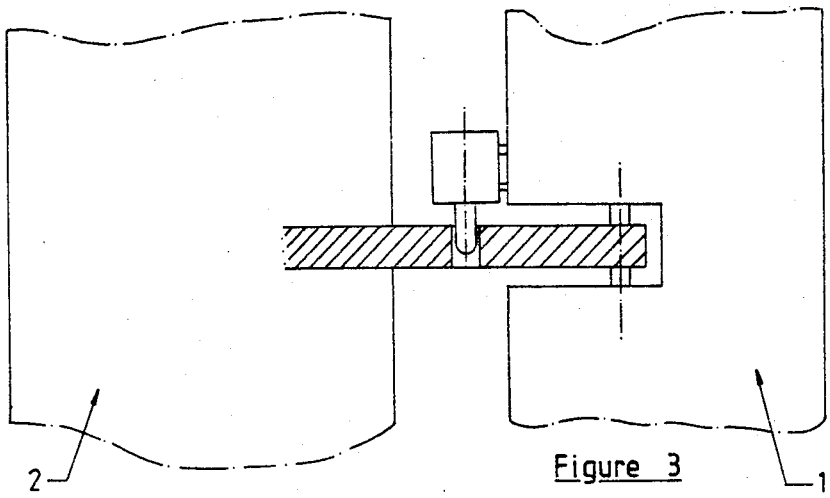
FIG. 3 is a diagram of a hydraulically operated pinlock.

This sequence is shown in FIGS. 4 to 7, commencing from a position shown in FIG. 2 in which the tail vane designated by reference 6 is aligned with the main wing, of which both airfoil sections 1 and 2 are also aligned and weathercocked to the wind. In general a plurality of wings will be arranged alongside each other and be interconnected to be rotated as a unit by the tail vane, with the flaps interconnected to move together. The device for moving the flaps may then be mounted on a stay interconnecting the wings, as shown in FIG. 2 with hydraulic ram 5 mounted on a spar 7.

Figure 4:
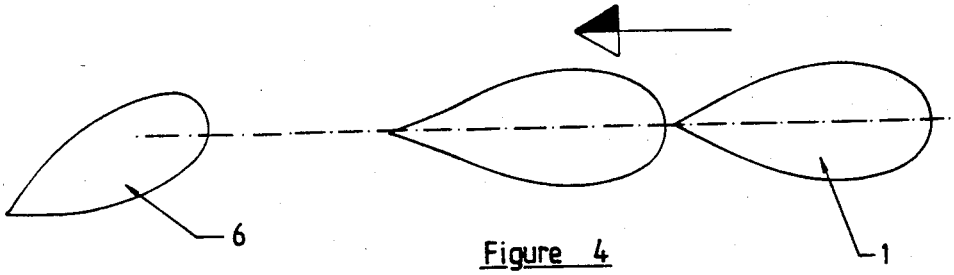
FIGS. 4 to 6 are a schematic diagrams of a self trimming wingsail rig undergoing flap deflection.
Figure 5:
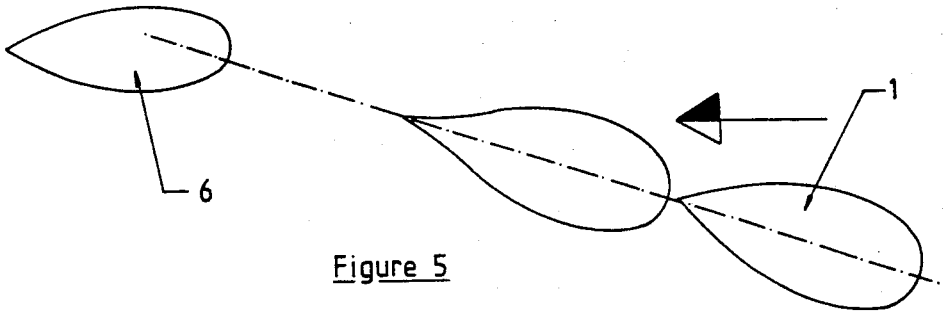
Figure 6:
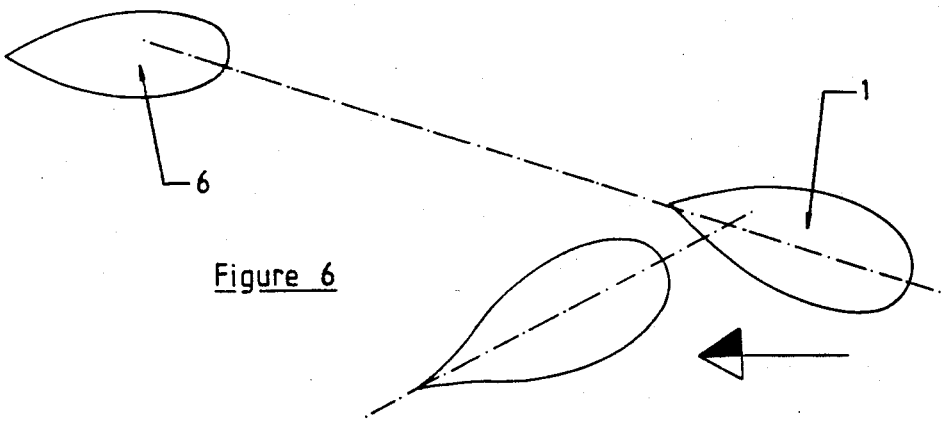
Figure 7:
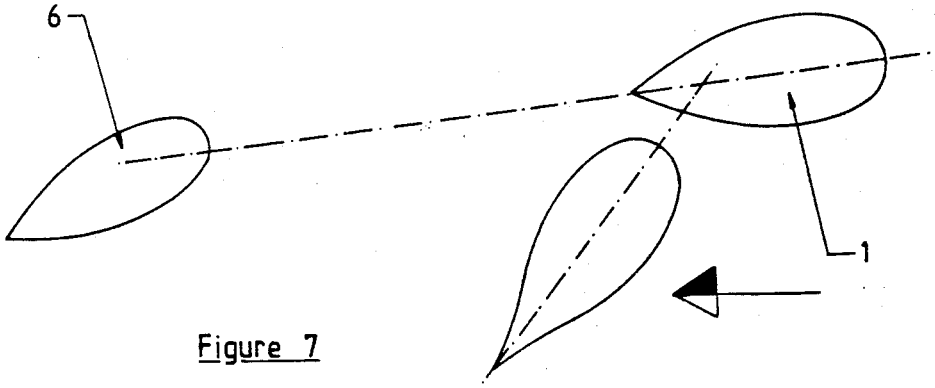
FIG. 7 is a schematic diagram of a self trimming wingsail rig with a governor vane set for trimming.

In FIG. 4 the tail vane has been deflected to its maximum position in one direction (down as viewed) and by virtue of the tail vane realigning itself to the wind it rotates the main wing system about its axis as shown in FIG. 5. Deflection in the downward as viewed direction of the flap 2 to the position shown in FIG. 6 is now aided by the wind, and upon achieving maximum deflection the flap 2 is locked in position and the moving mechanism relieved of stress. FIG. 7 shows the tail vane set at a different angle to trim the main wing to the desired angle of attack.

The same procedure can be repeated in reverse for the other tack.

Figure 8:
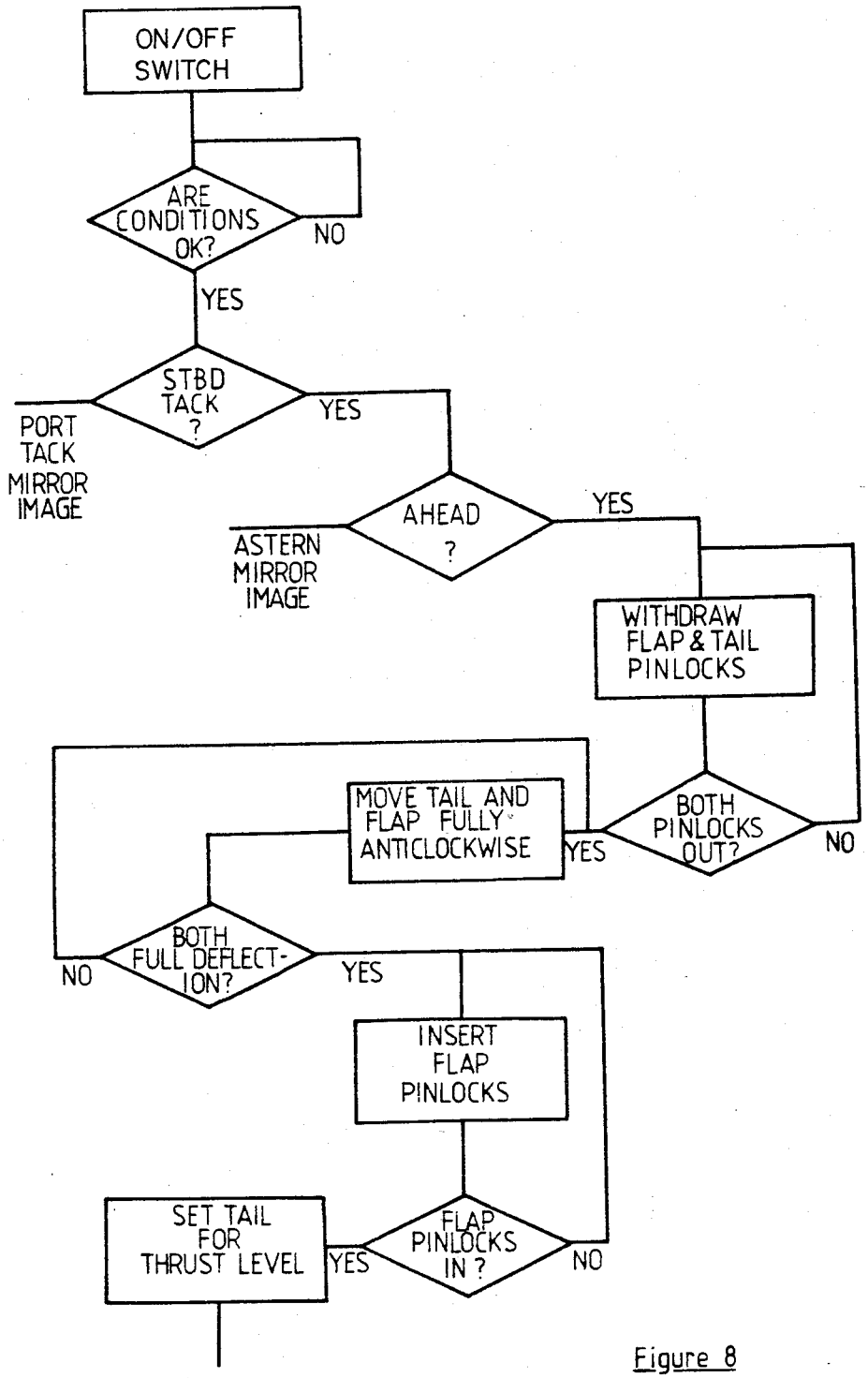
FIG. 8 is a flow diagram for a control system for changing camber.

Preferably the sailing conditions are monitored continually and a control system including a microprocessor ascertains whether a change of camber, such as for changing tack, is required. FIG. 8 shows a simplified flow diagram for the change of tack control system. In the diagram the tail and flap movements are linked, however in practice it may be preferable to treat these separately and interrogate 'is tail lock out' with the command 'move tail' following the affirmative, and the interrogation 'is flap lock out' followed by 'move flap' for the respective affirmative response.

Figure 9:
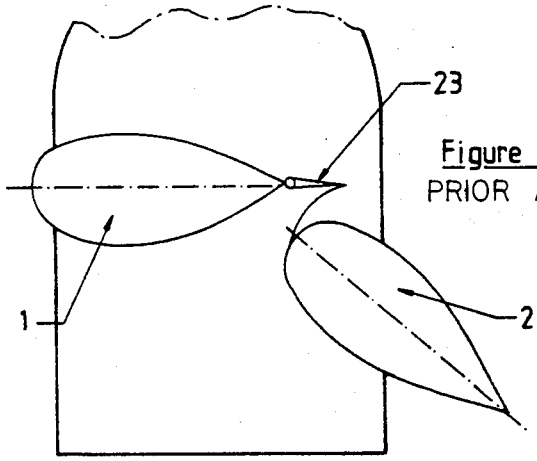
Figure 9 PRIOR ART
FIG. 9 shows a multi-element wingsail cambered for ahead port tacking.
Figure 10:
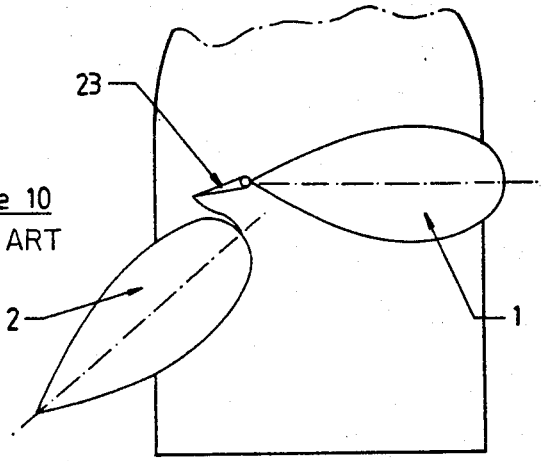
Figure 10 PRIOR ART
FIG. 10 shows a multi-element wingsail cambered for ahead starboard tacking.

A wingsail comprising a leading element 1, a flap 2 and slat 23 is shown in FIGS. 9 and 10 in the configurations that may be adopted respectively for sailing on port and starboard tack. Similar sailset configurations, but with the boat direction rotated by 180° correspond to astern sailing on starboard and port tacks. Preferably, as shown, the leading element is a sail in the form of a rigid, preferably symmetrical, upright airfoil rotatable about an upright axis. The trailing element, or flap (2), may be similar and the air-directing slat 23 may also be a rigid airfoil. The general arrangement may be as disclosed in European Patent specification No. 0061291.

Figure 11:
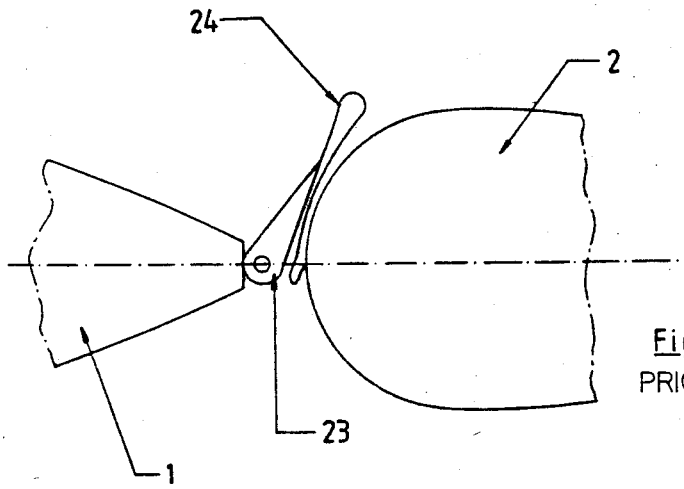
Figure 11 PRIOR ART
FIG. 11 shows the position reached in changing from ahead port to starboard tack.

It will be seen from FIG. 11 that when the flap 2 passes through the central position the slat 23 is pressed against the leading edge of the flap, and the position shown in FIG. 11 is that which is adopted when the flap is centralised from the ahead port tack shown in FIG. 9 prior to achieving the starboard tack of FIG. 10. The slat continues to be pushed by the flap until flap 2 has been deflected far enough for the gap between the element 1 and flap 2 to permit the slat 23 to pass through, which it does by virtue of wind pressure and centering springs Generally the slat 23 is made as long as possible and so the change of side of the slat occurs just before the flap has reached maximum deflection. The cable 24 is made of a length determined by the desired nozzle configuration.

Figure 12:
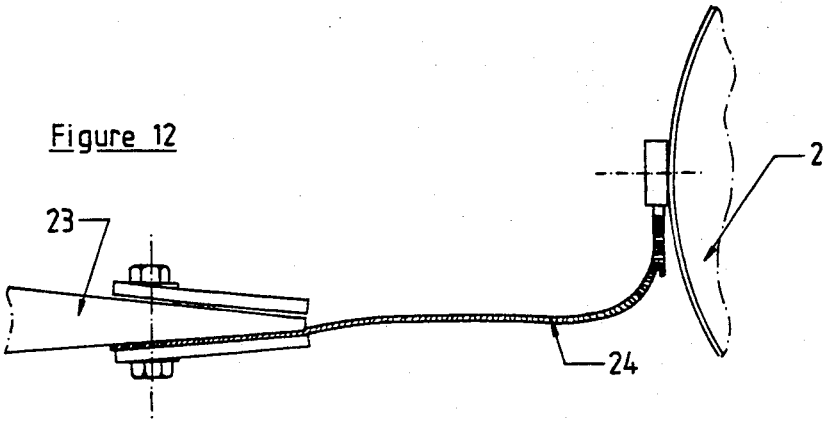
FIG. 12 shows a method of attachment of a cable on a wingsail.

If the cable 24 is clamped at the trailing edge of the slat and attached to the leading edge of the flap by a thimble or similar arrangment, for example as shown in FIG. 12, then the cable may suffer from chafe and also 'hanging up' during tack change, the mounting also obstructing the passage of the slat.

Figure 13:
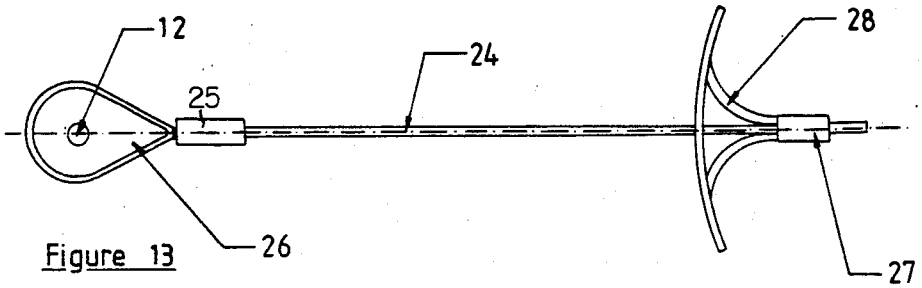
FIG. 13 shows a preferred embodiment of cable fixings.
Figure 14:
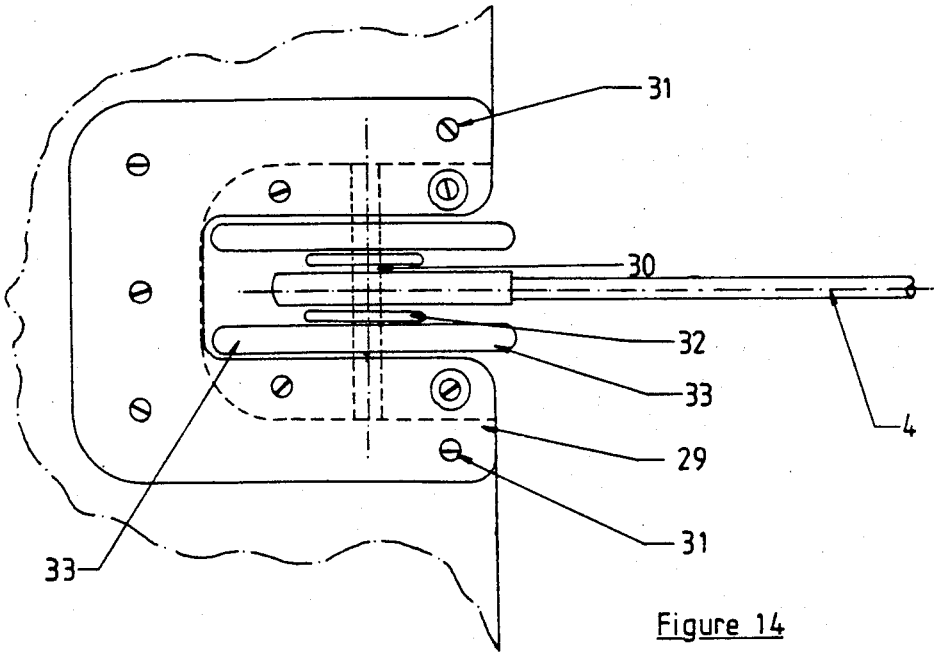
FIG. 14 shows a preferred embodiment of attachment of the cable at the trailing edge of the slat.

A preferred arrangement according to the invention for the cable is shown in FIG. 13. The cable, which is made of stainless steel and may be plastics covered, is swaged at 25 to a solid thimble 26 at the slat end and swaged at 27 at a special fitting 28 for attachment to the flap. Preferably the slat is made of metal with a riveted or welded trailing edge, although other arrangements are possible, and has a cut out position indicated generally at 29 in FIG. 14. A pivot 30 is located within the cut out, being secured in position by side plates 31. The solid thimble 26 has an aperture 12 in the centre portion, and this aperture is threaded on pivot pin 30 between spacing washers 32. Two wheels 33 are also threaded on the pivot pin, one on each side of the thimble, the rim of the wheel extending beyond the trailing edge of the slat.

At the other end of the cable 24, the object is to provide an unobtrusive fixing flush with the surface of the flap. The fitting 28, shown in more detail in FIG. 15, comprises a plate 34 of a curvature that conforms with the leading edge of the flap, and preferably the leading edge of the flap is recessed so that the plate fits flush with the rest of the surface of the flap. The centre part of the plate has a recess with substantially flat upper end and lower walls and and inwardly curving side walls 37 and 38 so that viewed from above the walls 37 and 38 define a 'horn' shape. The separation of the upper and lower walls and is just larger than the thickness of the cable 24 and any covering, and curvature of the walls 37 and 38 are chosen so that the radius of curvature is more than the minimum radius of curvature to which the stainless steel cable should be subjected. At the inward (narrow) end of the recess there is preferably a tubular section to which the cable may be swaged, but if the recess is formed from a material unsuitable for swaging a separate swage 39 may be made as shown in FIG. 15. The horn recess may be formed separately from the plate and joined to it.

A modification to the plate and horn recess is shown in FIG. 16, where a tool is plunged through the plate to form two curved ramps 37*a* and 38*a* to which the swage on the end of the cable may be mounted. In order to facilitate such attachment the swage portion may have a turned recess so that it may be sprung over the curved ramps, clamped and then welded or brazed to fix it in place.

The leading edge of the flap may be provided with a recess (FIG. 17) to accommodate the ramps or horn and swage, and this is particularly desirable if the ramp structure is used, in order to prevent ingress of water into the flap, and in this instance either the plate or the flap is provided with a relieved portion for drainage.

In operation the flap end of the cable is firmly fixed and can take up configurations with the cable lying over the surface of either of the surfaces 37 or 38, but is prevented from adopting too great a curvature. The leading edge of the flap remains smooth except for the protrusion of the cable and so presents minimum interference to the slat as it moves from one side to the other. Passage of the slat over the leading edge of the flap is eased by the wheels attached to the trailing edge of the slat, the wheels rolling on the flap surface to reduce scuffing.

As the slat end of the cable, the thimble may be modified or replaced by a hollow thimble (or loop) filled by a solid stub with an aperture, and the stub may then be formed integrally with one or both of the spacing washers. The object of a solid or filled thimble is for the pivot pin to be a close but free fit, and of course this could be provided by modifying the pivot pin rather than the thimble.

Figure 18:
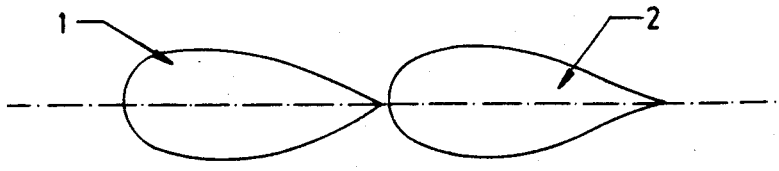
Figure 18 PRIOR ART
FIG. 18 is a schematic plan view of a two element wingsail in the symmetrical position.
Figure 19:
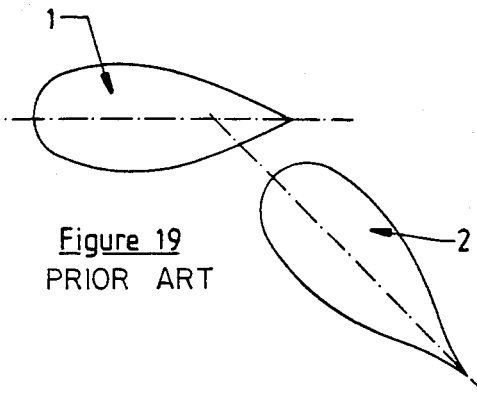
Figure 19 PRIOR ART
FIGS. 19 and 20 are schematic plan views of the wingsail of FIG. 18 in cambered configurations.
Figure 20:
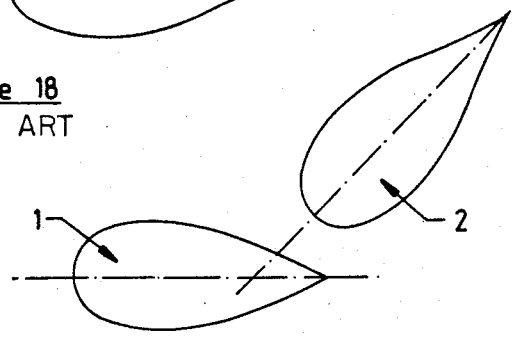
Figure 20 PRIOR ART

Referring now to FIG. 18 a wingsail is shown that comprises a leading element 1 and a trailing flap 2. The flap 2 can be deflected about a pivot to adopt the positions shown in FIGS. 19 and 20, the deflection being controlled by a system incorporating a fluid cylinder, such as a hydraulic ram. A problem with using a hydraulic ram is that during the inward stroke of the ram into the cylinder an area the size of the piston head is acted upon by the hydraulic fluid and during the outward stroke the area reacting on the fluid is the annulus defined by the piston head perimeter and the ram perimeter, and thus for a given flow rate of supply of fluid the speed of advance differs from the speed of withdrawal, leading to different rates of deflection depending upon whether the ram is on the inward or outward stroke.

Figure 21:
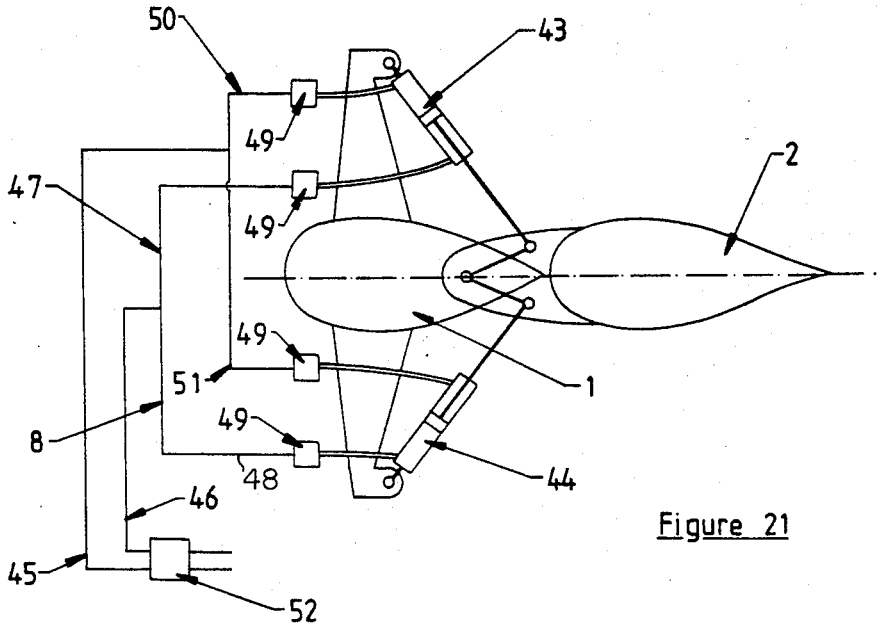
FIG. 21 is a schematic plan view of a hydraulic system according to the invention.

FIG. 21 shows a system in which two cylinders are utilised to provide equalisation of the deflection speed in each direction, and also to provide a failsafe system. Two hydraulic cylinders 43 and 44 are mounted on opposite sides of the flap 2, in a symmetrical arrangement, and hose lines 45 and 46 represent respectively the pump and tank lines for the hydraulic fluid. The pump line divides into branches 47 and 48 and each branch continues to a valve 49. Branch 47 then connects to the annulus side of hydraulic cylinder 43 and branch 48 connects to the full bore side of hydraulic cylinder 44. The tank line 46 divides similarly into branches 50 and 51 which connect respectively via more valves 49 to the full bore side of hydraulic cylinder 43 and the annulus side of hydraulic cylinder 44.

Thus in operation when a spool valve 52 is set to permit pressure flow the pressure is supplied to the full bore of cylinder 44 and the annulus of cylinder 43, while hydraulic fluid escapes to the tank from the full bore of cylinder 43 and the annulus of cylinder 44. This moves the flap in a given direction with a speed determined by the annulus/full bore combination and a reversal of the flow directions moves the flap in the opposite direction with the same speed.

The valves 49 are flow sensitive devices and are designed to shut if flow exceeds a predetermined rate, such as would occur if a pipe burst. Upon shut down of a valve 49, the flap movement continues, but at reduced speed powered only through the other cylinder.

Figure 22:
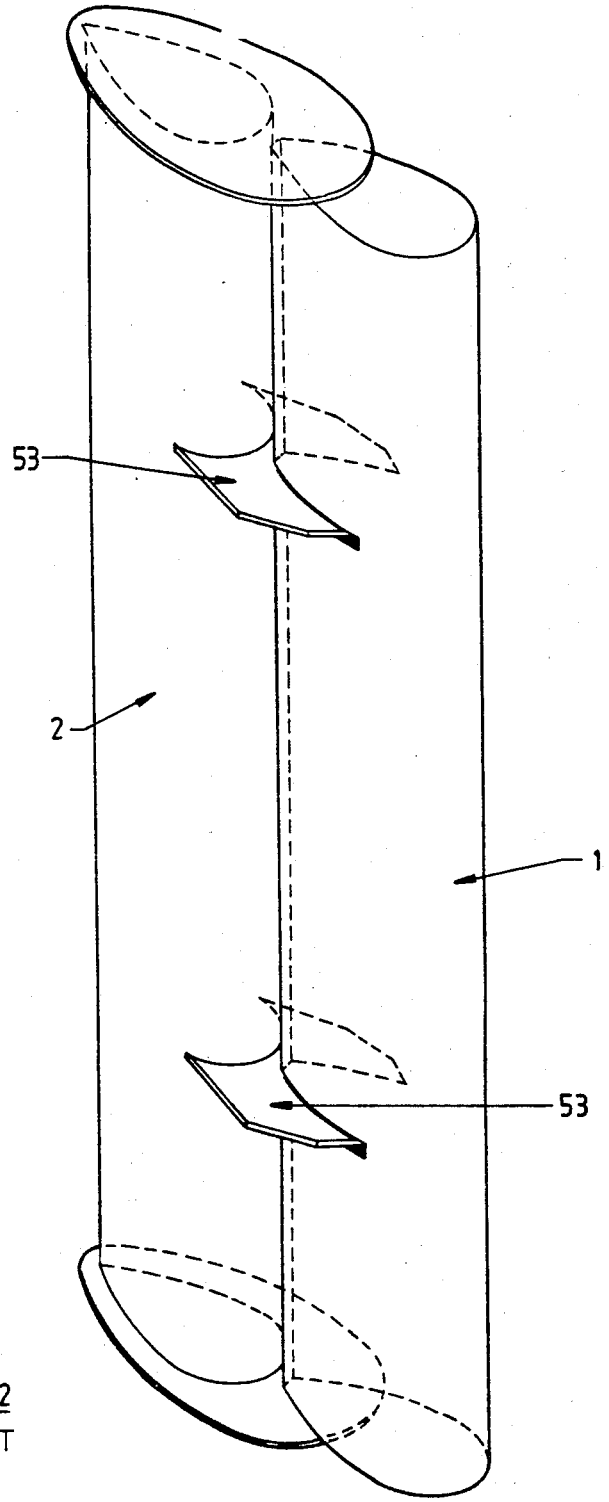
Figure 22 PRIOR ART
FIG. 22 is a perspective view of the wingsail assembly of FIG. 18.

The two cylinders may be displaced from one another vertically. For example, in a structure as shown in FIG. 22 one cylinder (not shown) may be placed at one hinge assembly indicated generally at 53, and the other at a different hinge assembly. More than one pair may be provided either in an alternate arrangement or in pairs on the hinge assembles. During deflection the loads are shared by the cylinders in the ratio of their full bore and annulus areas, the imbalance being distributed by the torsional stiffness of the flap.

Figure 23:
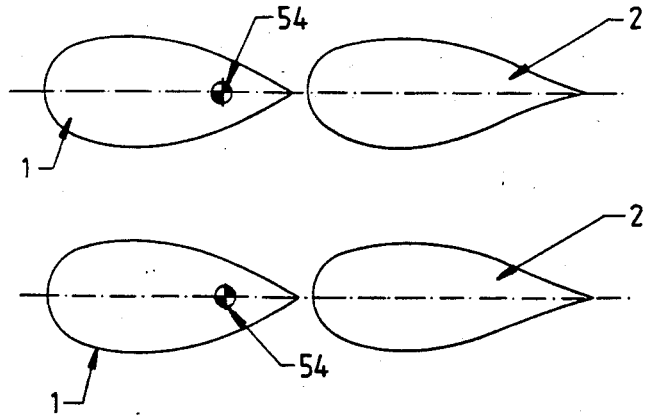
FIG. 23 is a schematic diagram of a pair of thrust wings.

The apparatus has been described in the context of a multielement wingsail, however a similar arrangement could be used for deflecting other airfoil members of a wingsail system, for example a governor such as a tail vane as shown in FIG. 23.

In FIG. 23 a twin plane set of thrust wings is illustrated, each thrust wing comprising a leading element 1 and a trailing flap element 2. The flaps 2 are pivotable about an axis 54 located on the centre chord of the respective leading elements, so that each flap is capable of being deflected laterally to each side of its respective leading element. The spacing of the leading element is fixed and maintained by members interconnecting the two leading elements at intervals in the upright direction, so that the leading elements are maintained parallel to one another.

Deflection of the flaps may be achieved by a control system including fluid cylinders: each flap may have its own fluid cylinders or one may be driven and the others connected to follow as slaves, this latter arrangement being more suitable for systems with three or more wings with a central (or a central pair) of flaps being driven and the outer flaps being slaves. In all cases the operation of such a system of wings generally requires the flaps to be moved together and so whether by virtue of physical interconnection or by a control mechanism the flaps are moved in unison.

Figure 24:
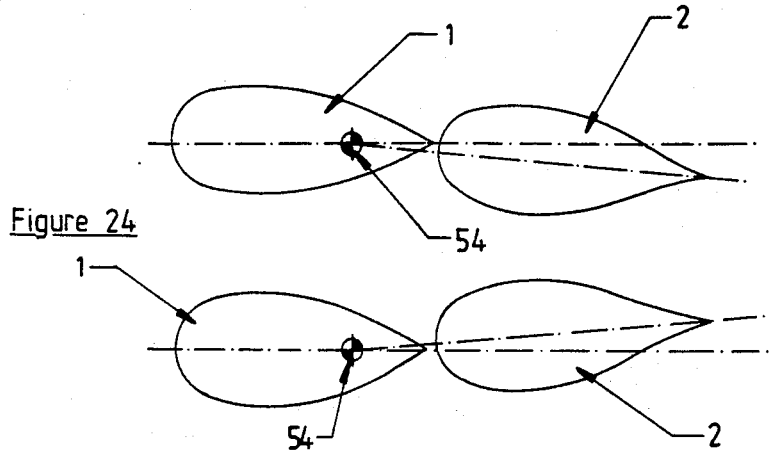
FIG. 24 is a schematic diagram of a pair of thrust wings in the 'toe-in' configuration.
Figure 25:
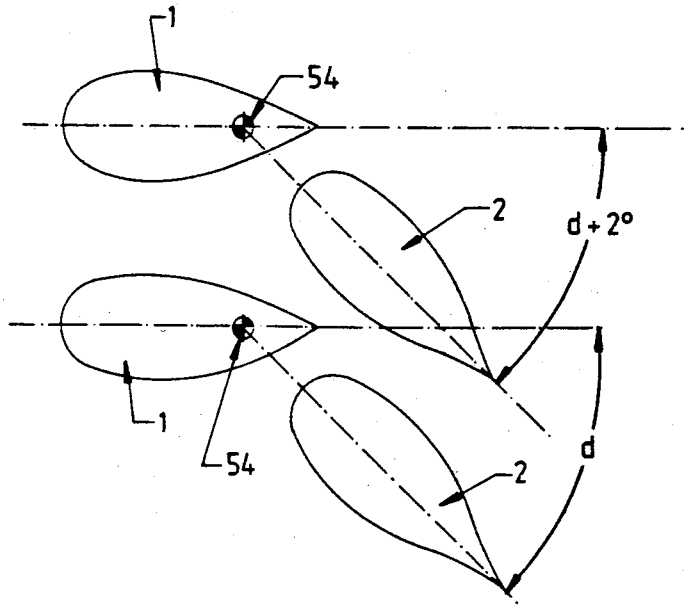
FIG. 25 is a schematic diagram of a pair of the wings of FIG. 24 with the flaps deflected.

The natural arrangement is for the flaps to be maintained parallel to one another, so that the camber presented by each leading element and its flap is the same. However it is now proposed for the flap arrangement to be made non-parallel so that the position shown in FIG. 24 is adopted in the symmetrical position, with the trailing edges of the flaps being slightly closer together than the spacing of the leading edge: this arrangement is termed 'toe-in'. The effect of toe-in in the symmetrical position is that once the flaps are deflected, as shown in FIG. 25, the leeward flap is deflected to a greater angle than the windward flap, and thus as stalling is approached the leeward wing stalls first and more deeply than the windward wing. The extent of the 'toe-in' determines the difference in the flap angles, a difference of about 2° between the angles of adjacent flaps being preferred.

With a three wing system, the central flap will be left parallel with the leading elements and the outer flaps toed-in in the symmetrical positions to give for example angles of +38°, +40° and +42° when deflected, or on the oppostite tack angles of −38°, −40° and −42°. For configurations with four or more wings, pairs of wings may have differing degrees of toe-in in order to maintain the leeward progression to deeper stalling.

I claim:

1. In a wingsail arrangement comprising a thrust wing having an upright leading airfoil having a leading edge and a trailing edge and an upright trailing airfoil having a leading edge and a trailing edge, the leading edge of the trailing airfoil being positioned closely behind the trailing edge of the leading airfoil, means for mounting the trailing airfoil for pivoting movement about an upright axis relative to the leading airfoil from an aligned position in which the trailing airfoil is aligned with the leading airfoil to positions to each side of and angularly displaced from said aligned position, and a slat having a leading edge and a trailing edge pivoted at its leading edge to the trailing edge of the leading airfoil and connected to the leading edge of the trailing airfoil by at least one cable so as to be moved in response to pivoting movement of the trailing airfoil to form a linear nozzle when the trailing airfoil is angularly displaced from the aligned position; the improvement comprising an upright pivot pin disposed proximate the trailing edge of the slat, means for engaging the pivot pin attached to the cable to enable the cable to pivot about an upright axis relative to the slat, and at least one wheel rotatably mounted about an upright axis disposed proximate the trailing edge of the slat and extending beyond the trailing edge of the slat to prevent mutual engagement of the trailing edge of the slat and the flap.

2. The arrangement of claim 1 in which the pivot pin comprises the axis for said wheel.

3. The arrangement of claim 1 in which said means for engaging is disposed between a pair of wheels, the wheels and means for engaging having a common axis constituted by the pivot pin.

4. The arrangement of claim 1 in which the means for engaging comprises thimble with a central portion defining an aperture through which the pivot pin is threaded.

5. The arrangement of claim 1 further comprising a mounting assembly for the cable at the leading edge of the trailing airfoil, the mounting assembly comprising a member conforming to the curvature of and fixed to the leading edge of the trailing airfoil and having a lateral slot therein, and means for attaching the cable extending from the slat within the mounting assembly with the cable extending through the slot.

6. The arrangement of claim 5 further comprising a recess in the leading edge of the trailing airfoil for accommodating the mounting assembly.

7. The arrangement of claim 1 further comprising curved ramp portions extending from at least the ends of the slot to said means for attaching.

* * * * *